US007128617B2

(12) United States Patent
Wang et al.

(10) Patent No.: US 7,128,617 B2
(45) Date of Patent: Oct. 31, 2006

(54) ELECTRICAL SOCKET ASSEMBLY AND PLUG CONNECTOR COUPLED THERETO

(75) Inventors: Eric Wang, Taipei Hsien (TW); Ming-Chung Wang, Taipei Hsien (TW)

(73) Assignee: Advanced Connection Technology Inc., Taipei Hsien (TW)

( * ) Notice: Subject to any disclaimer, the term of this patent is extended or adjusted under 35 U.S.C. 154(b) by 0 days.

(21) Appl. No.: 11/015,856

(22) Filed: Dec. 16, 2004

(65) Prior Publication Data

US 2006/0134983 A1 Jun. 22, 2006

(51) Int. Cl.
*H01R 24/00* (2006.01)

(52) U.S. Cl. ..... 439/660; 439/607; 439/939

(58) Field of Classification Search ..... 439/607, 439/660, 939

See application file for complete search history.

(56) References Cited

U.S. PATENT DOCUMENTS 6,086,430 A * 7/2000 Amoni et al. ..... 439/680
6,113,426 A * 9/2000 Lin ..... 439/607

* cited by examiner

*Primary Examiner*—Truc Nguyen
(74) *Attorney, Agent, or Firm*—Darby & Darby

(57) ABSTRACT

An electrical socket assembly includes an insulating body, a plurality of first terminals, and a plurality of second terminals. The insulating body has first terminal grooves formed on a lower side thereof, and second terminal grooves formed on an upper side thereof. The first terminals are respectively positioned in the first terminal grooves for transmitting non-USB-compliant signals, and the second terminals are respectively positioned in the second terminal grooves for transmitting and receiving USB-compliant signals. The electrical socket assembly may be coupled with a standard USB plug connector for transmission of the USB-compliant signals, and with another plug connector for transmission of the non-USB-compliant signals.

7 Claims, 3 Drawing Sheets

ELECTRICAL SOCKET ASSEMBLY AND PLUG CONNECTOR COUPLED THERETO

BACKGROUND OF THE INVENTION

1. Field of the Invention

The present invention relates to an electrical socket assembly, and more particularly to an electrical socket assembly that conforms to universal serial bus (USB) specifications, and that has the ability to transmit both USB- and non-USB-compliant signals. The present invention relates also to a plug connector that is electrically coupled to the electrical socket assembly for transmitting the non-USB-compliant signals.

2. Description of the Related Art

It is becoming the standard for digital devices that interface with a PC (personal computer) to be USB-based. Examples of such digital devices include MPEG (Moving Pictures Experts Group) Audio Layer-3 players, which are commonly referred to simply as MP3 players, digital cameras, and digital camcorders.

In the case of the MP3 player, this digital device typically includes the player itself with all the required circuitry and buttons for user manipulation, an audio port, and a data port. An MP3 player is used in conjunction with a pair of earphones or headphones, and a cable for connection to a PC. An earphone connector of the earphones is connected to the audio port of the MP3 player. The cable, assuming that the MP3 player is USB-based, has a USB "A" connector on one end for connection to a USB socket of a PC, and a mini USB "B" connector on its other end for connection to the data port of the MP3 player. There are many different types of mini USB "B" connectors, but the USB "A" connector is standardized to enable coupling to the USB socket of any PC or USB hub.

In order to listen to music, the user connects the earphones to the audio port, and operates the MP3 player. When desiring to transfer MP3 files from the PC to the MP3 player, the user connects the mini USB "B" connector of the cable to the data port of the MP3 player, and the USB "A" connector of the cable to the USB socket of the PC. Hence, two different ports are required for one MP3 player. This runs counter to efforts at making the MP3 player more lightweight and compact, and increases overall manufacturing costs. Another drawback of the conventional configuration is that the connection life between the earphone connector of the earphones and the audio port of the MP3 player is limited, i.e., approximately 10,000 connections. That is, wear in at least one of the elements becomes too severe following 10,000 connections and disconnections. This is in contrast to USB connectors and sockets, which have a connection life of approximately three times that of other connectors and sockets, such as the earphone connector and audio port.

SUMMARY OF THE INVENTION

The object of this invention is to provide an electrical socket assembly that conforms to USB specifications, and that has the ability to transmit both USB- and non-USB-compliant signals. Another object of this invention is to provide a plug connector that is electrically coupled to the electrical socket assembly for transmission of the non-USB-compliant signals.

The electrical socket assembly includes: an insulating body having a seat, a connection plate which projects outwardly from the seat and which has opposite first and second sides, first terminal grooves formed in the first side of the connection plate, and second terminal grooves formed in the second side of the connection plate; a shield housing surrounding said seat and said connection plate; a plurality of first terminals respectively positioned in the first terminal grooves for transmitting non-USB-compliant signals; and a plurality of second terminals respectively positioned in the second terminal grooves for transmitting and receiving USB-compliant signals.

A plug connector is matable with the electrical socket assembly. The plug connector has a plurality of third terminals for contacting the first terminals, respectively. The electrical socket assembly can mate with a standard USB plug connector having fourth terminals for contacting the second terminals, respectively. The plug connector has no terminals to contact the second terminals when mating with the electrical socket assembly.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
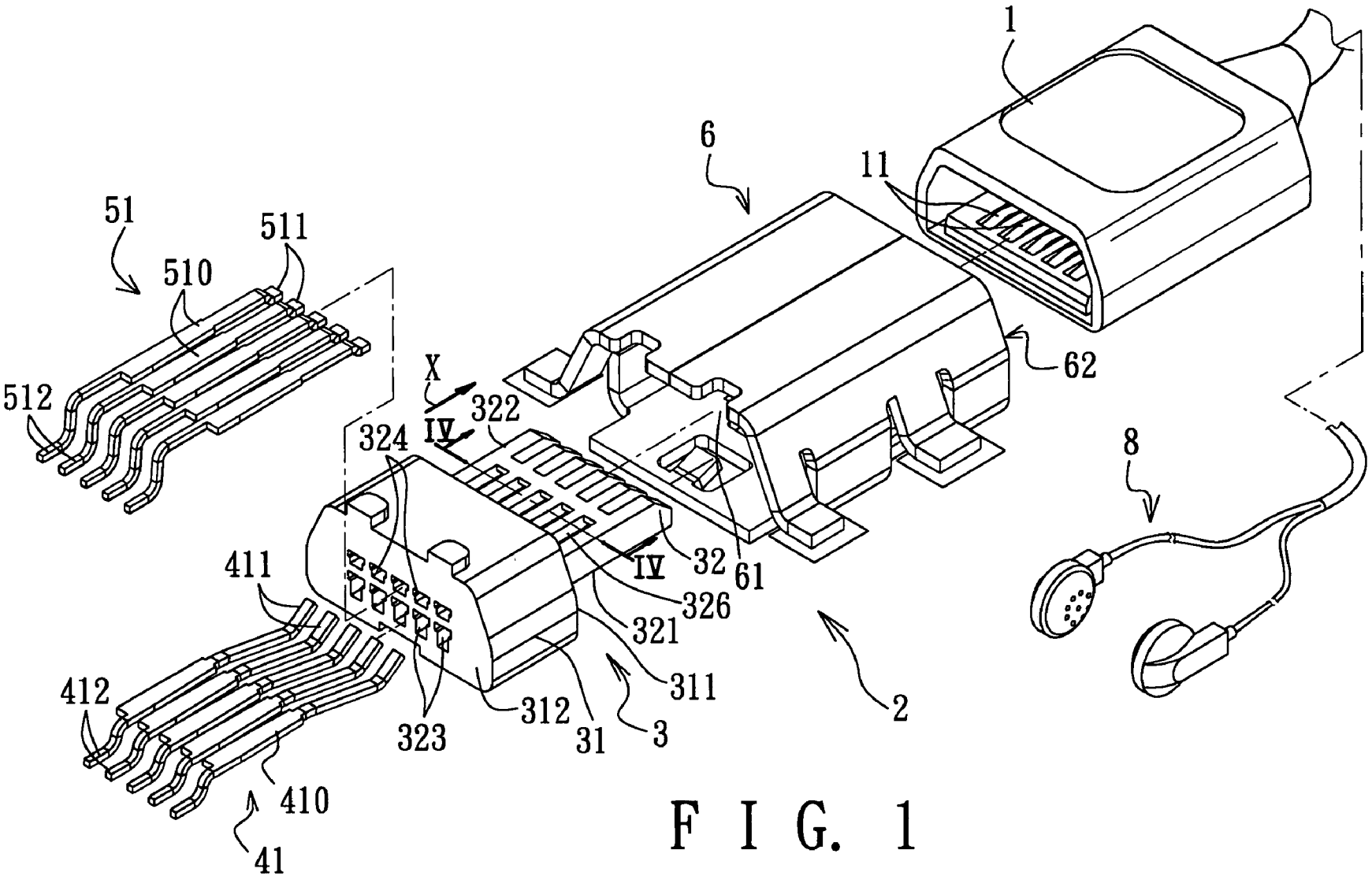
FIG. 1 is an exploded perspective view of an electrical socket assembly and a plug connector according to a preferred embodiment of the present invention.
Figure 2:
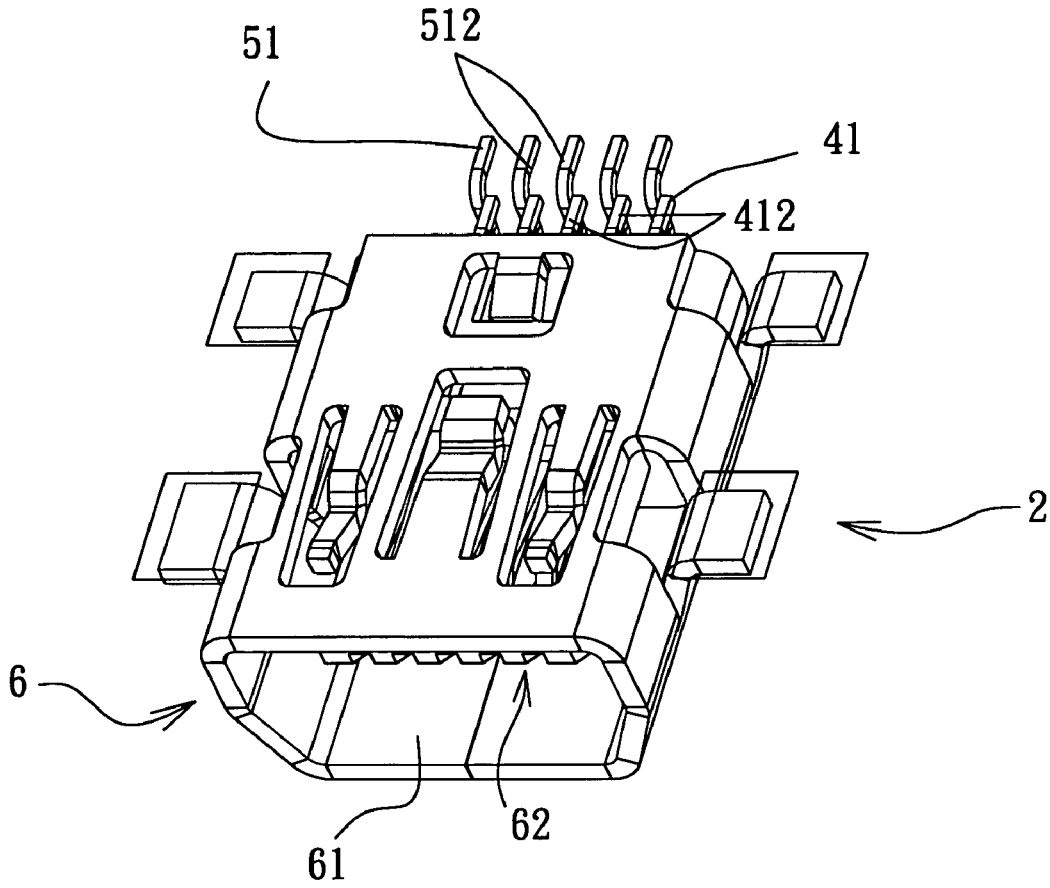
FIG. 2 is a perspective view of the electrical socket assembly of FIG. 1, illustrating the electrical socket assembly in an assembled state.

Referring to FIGS. 1 and 2, an electrical socket assembly 2 according to a preferred embodiment of the present invention is employed in an electronic device (not shown), such as an MP3 player. The electrical socket assembly 2 is electrically coupled to a circuit board of the electronic device, and allows for the transfer of both USB- and non-USB-compliant signals. For example, the electrical socket assembly 2 allows for the transfer of both data and audio signals. The electrical socket assembly 2 conforms to USB specifications to thereby allow for the connection of a USB cable (not shown) thereto. As an example, a 5-pin mini USB "B" connector of the cable is connected to the electrical socket assembly 2, and a USB "A" connector of the cable is connected to a USB socket of a data transfer device (not shown), such as a PC, thereby allowing for data transfer to the electronic device from the data transfer device. The electrical socket assembly 2 may be configured to allow for the reception of various types of mini USB "B" connectors thereto, and may even be configured to enable connection with a standard USB "B" connector.

A plug connector 1 according to a preferred embodiment of the present invention may also be connected to the electrical socket assembly 2. This interconnection between the plug connector 1 and the electrical socket assembly 2 allows for the transmission of the above-mentioned non-USB-compliant signals from the electronic device. If the non-USB-compliant signals include audio signals, output may be performed to a signal output device 8, such as a set of headphones.

The electrical socket assembly 2 includes an insulating body 3, a shield housing 6, a plurality of first terminals 41, and a plurality of second terminals 51.

Figure 4:
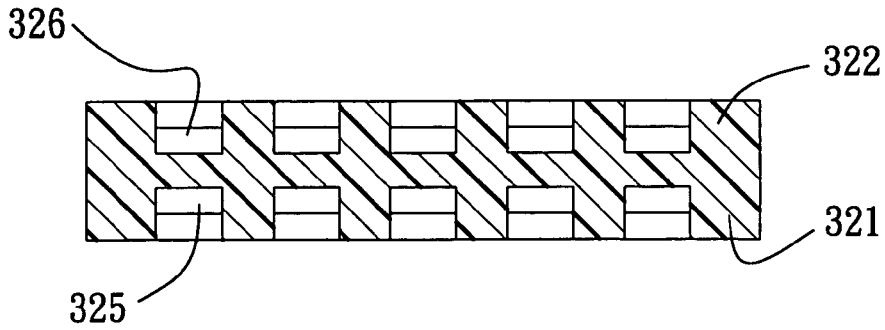
FIG. 4 is a sectional view of a connection plate of the electrical socket assembly taken along line IV—IV of FIG. 1.

The insulating body 3 includes a seat 31 having a front surface 311 and a rear surface 312, and a connection plate 32 integrally extended outwardly from the front surface 311 of the seat 31 along a forward, long axis direction (X) of the electrical socket assembly 2. The connection plate 32 includes a first side 321 and a second side 322 provided respectively on lower and upper sides of the connection plate 32. With reference also to FIG. 4, a plurality of spaced-apart first terminal grooves 325 are formed in the first side 321 and extend starting from the seat 31 along the long axis direction (X), and a plurality of spaced-apart second terminal grooves 326 are formed in the second side 322 and extend starting from the seat 31 along the long axis direction (X).

A plurality of spaced-apart first passageways 323 are formed through the seat 31 extending from the front surface 311 to the rear surface 312 thereof along the long axis direction (X), and are respectively aligned with the first terminal grooves 325 of the connection plate 32. Further, a plurality of spaced-apart second passageways 324 are formed through the seat 31 extending from the front surface 311 to the rear surface 312 thereof along the long axis direction (X), and are respectively aligned with the second terminal grooves 326 of the connection plate 32. Hence, the first passageways 323 are formed under the second passageways 324.

The shield housing 6 defines a connecting space 61 for receiving the insulating body 3, and a connecting opening 62 in spatial communication with the connecting space 61. The plug connector 1 is inserted in the connecting space 61 through the connecting opening 62. In this embodiment, the shape and size of the connecting opening 62 correspond to USB specifications to enable reception of one of the different types of mini USB "B" connectors.

The first terminals 41 are inserted into the first passageways 323, and are used both to transmit non-USB-compliant signals and for grounding purposes. As an example, the signals transmitted through the first terminals 41 include audio signals. That is, one of the first terminals 41 may be used to transmit monophonic audio signals, two of the first terminals 41 may cooperate to transmit stereophonic audio signals, another one of the first terminals 41 may be grounded, and the remaining first terminals 41 may be used to transmit microphone signals, line control signals, etc. Each of the first terminals 41 includes a middle section 410 seated in one of the first passageways 323 of the insulating body 3, a contact end 411 protruded from the front surface 311 of the insulating body 3 and at least partly positioned in one of the first terminal grooves 325 of the connection plate 32 of the insulating body 3, and a coupling end 412 protruded from the second surface 312 of the insulating body 3.

The second terminals 51 are inserted into the second passageways 324, and are used to transmit USB-compliant signals. Each of the second terminals 51 includes a middle section 510 seated in one of the second passageways 324 of the insulating body 3, a contact end 511 at least partly positioned in one of the second terminal grooves 326 of the connection plate 32 of the insulating body 3, and a coupling end 512 protruded from the second surface 312 of the insulating body 3.

The connecting opening 62 of the shield housing 6 is proximate to the contact ends 411 of the first terminals 41, and to the contact ends 511 of the second terminals 51. The coupling ends 412, 512 of the first and second terminals 41, 51, respectively, protrude from the shield housing 6 as described above to thereby allow for electric coupling of the first and second terminals 41, 51 to the circuit board of the electronic device in which the electrical socket assembly 2 is mounted.

Figure 3:
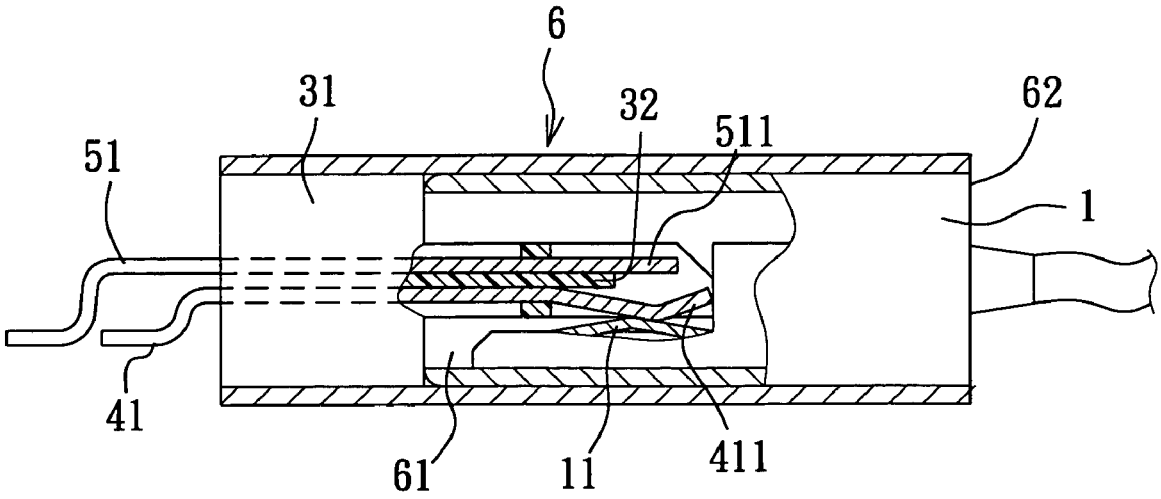
FIG. 3 is a sectional view of the electrical socket assembly and the plug connector of FIG. 1, illustrating the electrical socket assembly and the plug connector in an assembled and interconnected state.

The plug connector 1 includes a plurality of third terminals 11 for contacting the contact ends 411 of the first terminals 41, respectively, as shown in FIG. 3, when the plug connector 1 is inserted into the shield housing 6. It is noted that none of the third terminals 11 are in contact with any of the second terminals 51 when the plug connector 1 is inserted into the shield housing 6. The third terminals 11 of the plug connector 1 receive non-USB-compliant signals from the first terminals 41.

Figure 5:
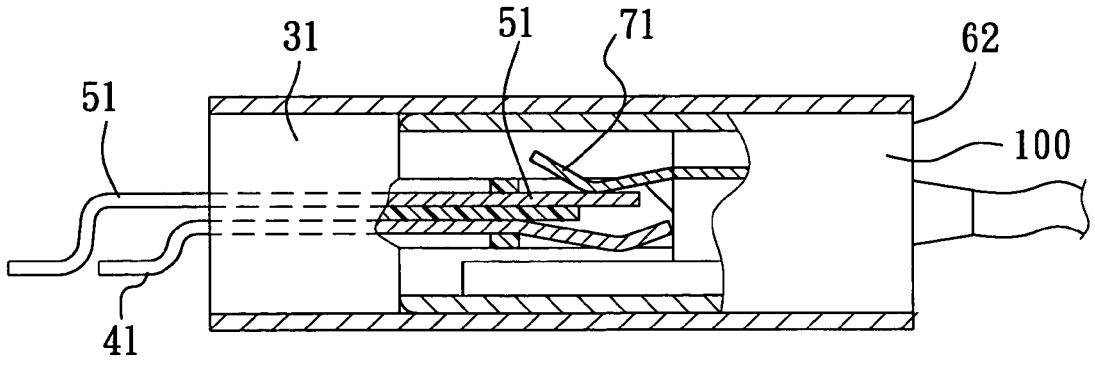
FIG. 5 is a sectional view of the electrical socket assembly of FIG. 1, illustrating the electrical socket assembly in a state interconnected with a standard mini USB "B" connector.

With reference to FIG. 5, when a standard mini USB "B" connector 100 is inserted into the shield housing 6 through the opening 62, fourth terminals 71 in the mini USB "B" connector 100 are in electrical contact with the second terminals 51, respectively. This allows for the transfer of USB-compliant signals to the electronic device.

The electrical socket assembly 2 according to the preferred embodiment of the present invention is able to transmit both USB- and non-USB-compliant signals. Hence, the electronic device to which the electrical socket assembly 2 is applied need not employ two different sockets, as in the prior art device. This allows for a more compact structure of the electronic device, and lower manufacturing costs. Further, since the electrical socket assembly 2 is made using USB technology, wear occurring from connecting and disconnecting the plug connector 1 or a standard USB connector to and from the electrical socket assembly 2 is less than that when using other conventional connection structures. In addition, because of the shielding that results from utilizing the USB structure, the quality of the signals through the electrical socket assembly 2 is better than that when using a conventional socket and earphone connector combination.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An electrical socket assembly, comprising:

an insulating body including a seat, a connection plate which projects outwardly from said seat and which has opposite first and second sides, first terminal grooves formed in said first side of said connection plate, and second terminal grooves formed in said second side of said connection plate;

a shield housing surrounding said seat and said connection plate;

a plurality of first terminals respectively positioned in said first terminal grooves for transmitting non-USB-compliant signals; and a plurality of second terminals respectively positioned in said second terminal grooves for transmitting and receiving USB-compliant signals, wherein the first terminals are non-USB terminals, and wherein the second terminals are USB terminals.

2. The electrical socket assembly of claim 1, wherein each of said first terminals has a contact end exposed on said first side, and a coupling end projecting out of said seat.

3. The electrical socket assembly of claim 2, wherein each of said second terminals has a contact end exposed on said second side, and a coupling end projecting out of said seat.

4. The electrical socket assembly of claim 1, wherein the non-USB-compliant signals include audio signals.

5. An electrical connector assembly, comprising:

an electrical socket and a plug connector matable with said electrical socket;

said electrical socket including:

an insulating seat, a connection plate which projects outwardly from said seat and which has opposite first and second sides, first terminal grooves formed in said first side of said connection plate, and second terminal grooves formed in said second side of said connection plate;

a plurality of first terminals respectively positioned in said first terminal grooves for transmitting audio signals; and a plurality of second terminals respectively positioned in said second terminal grooves for transmitting and receiving data signals;

a shield housing surrounding said insulating seat and said connection plate;

said plug connector having a plurality of third terminals for contacting said first terminals, respectively;

wherein the first terminals are non-USB terminals, and wherein the second terminals are USB terminals.

6. The electrical connector assembly of claim 5, wherein said electrical socket is further adapted for mating with a standard USB plug connector having fourth terminals for contacting said second terminals, respectively.

7. The electrical connector assembly of claim 6, wherein said plug connector has no terminals to contact said second terminals when mating with said electrical socket.

* * * * *